United States Patent [19]

Reneau

[11] 4,277,813

[45] Jul. 7, 1981

[54] ENVIRONMENTAL SIGNAL SWITCH FOR MOTOR VEHICLES

[76] Inventor: Paul A. Reneau, 9261 N. 60th St., Brown Deer, Wis. 53223

[21] Appl. No.: 61,384

[22] Filed: Jul. 27, 1979

[51] Int. Cl.[3] ..... H01H 47/24

[52] U.S. Cl. ..... 361/173; 361/178; 307/10 R

[58] Field of Search ..... 361/173, 175, 178; 307/10 R, 117, 118

[56] References Cited

U.S. PATENT DOCUMENTS

| | | | |
|---|---|---|---|
| 2,617,972 | 11/1952 | Nutter | 361/178 X |
| 3,794,847 | 2/1974 | Cadiou | 361/178 X |

*Primary Examiner*—Harry E. Moose, Jr

[57] ABSTRACT

The environmental signal switch is an electronic device primarily for automotive use which is responsive to the absence of daylight and moisture. The device is designed to send a signal to selected electronic devices, namely the gates of scr's to activateselected electrically operated devices. The switch is designed to send a signal to one or more scr gates only, in response to moisture, and send signals to the same said scr gates, and one or more additional scr gates in response to the absence of daylight. The device as used in automotive application is to allow for the closing of windows and roof panel in response to rain regardless to whether keys are left in the ignition. In response to the absence of daylight, said windows, roof panel, and door locks are activated, provided said keys are removed from the ignition. The switch can activate the said electrical devices directly or indirectly, by said means of activating the gates of said scr's. The said scr's can be part of an environmental security system.

4 Claims, 1 Drawing Figure

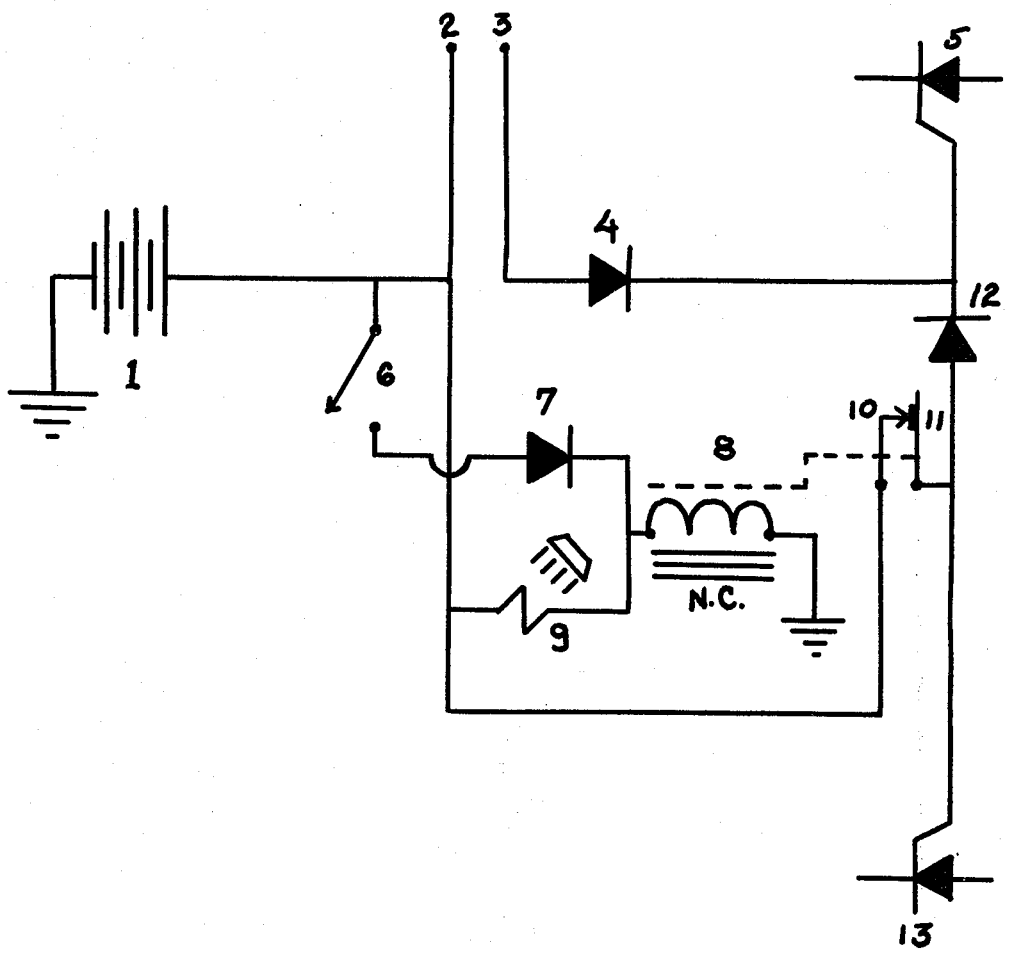
2
3
5
4
12
1
6
7
10
11
8
N.C.
9
13

ENVIRONMENTAL SIGNAL SWITCH FOR MOTOR VEHICLES

SUMMARY OF THE INVENTION

The device employs combining a moisture responsive switch and a daylight responsive switch (absence of daylight) into one switch unit, and it employs designing the said switch unit to activate selected electronic devices only in response to moisture and activating said devices plus other devices in response to the absence of daylight.

DESCRIPTION OF DRAWING

The drawing is a schematic representation of the electronic circuitry of the device. It represents the basic components necessary to display the essence of the invention.

The specification will provide a detailed description of the electronic schematic.

Beginning at the grounded storage battery 1, current is supplied to probe 2. Probe 3 is adjacent to probe 2, however no current is supplied to probe 3 until the two probes are bridged by a conductive medium (water).

Bridging the two probes allows current to pass directly to the desired electronic device 5 (gate of scr).

From said battery 1, current is also supplied to switch 6. Switch 6 is closed when keys are left in the ignition, and current passes to the coil of grounded normally closed relay 8, thus opening contacts 10 and 11.

When said keys are removed, switch 6, opens and no current reaches coil of said relay 8, thus returning said contacts 10 and 11 to the normally closed position.

Current is also supplied from said battery 1, directly to photoconductive cell 9. Photoconductive cell 9 is conductive in response to daylight, and current passes through said cell 9 to the coil of said relay 8, thus opening said normally closed contacts 10 and 11. In the absence of daylight, insufficient current passes to the coil of said relay 8, thus deactivating said coil and returning said contacts 10 and 11 to the closed position.

Current is continuously supplied directly from said battery 1 to relay contact 10. With said relay 8 activated by either of the two said means, said relay contacts 10 and 11 are open. Relay contact 11 is connected directly to the first said electronic device 5, and a second electronic device 13. Upon both the opening of said switch 6, and the deactivating of photoconductive cell 9, relay 8 contacts 10 and 11 return to the normally closed position. Said current from said battery 1, supplied directly to relay contact 10 can now pass to relay contact 11 and thus to said electronic devices 5 and 13.

REMARKS

As stated in the Abstract and Specification, the electronic device receiving the signal(s) can be an scr, but not necessarily only an scr. The scr indicates a method of supplying current to the said electrically operated devices (windows, roof panel and door locks).

In the Specification, diodes 4, 7, and 12 are not mentioned. They merely act to control the direction of the current flow. They are labeled in the drawing because they are necessary to make the device work properly.

What is claimed is as follows:

1. I claim a switching device for automotive use for the purpose of providing electrical current for activating electrical devices in response to moisture and the absence of daylight, the combination comprising a storage battery, moisture probes, a photoconductive cell, a direct current relay with sets of normally closed contacts, two (2) signal circuits from said battery to said electrical devices, two (2) or more electrical devices for receiving said signals (electrical current) of said signal circuits, the first said signal circuit having said moisture probes in series between said battery and said first electrical device(s), the said probes forming a closed switch between said battery and said first electrical device(s) when bridged by moisture (a conductive medium) and closing said first signal circuit to said first electrical device(s), the opening of said closed moisture switch opening said first signal circuit, the said second signal circuit having sets of said normally closed relay contacts in series between said battery and said first and said second electrical devices, two (2) circuits for engaging said relay, the first said engaging circuit being from said battery directly to the coil of said relay and also having a switch in series between said battery and said relay coil, the closing of said switch closing said first engaging circuit, the said second engaging circuit for said relay being in parallel with said first engaging circuit and having said photoconductive cell connected in series between said battery and said relay coil, the said cell being normally conductive in response to daylight, the said closed switch (cell) closing said second engaging circuit for said relay, the engaging of said relay is by means of closing any of the said engaging circuits, the said engaging of said relay opening said sets of normally closed contacts, the opening of said relay contacts opening said second signal circuit to all said electrical devices, the closing of said first signal circuit by said means activating only said first electrical device(s), the closing of said second signal circuit is by means of opening both said relay engaging circuits, the said opening of said engaging circuits closing said sets of normally closed relay contacts, the said closing of said second signal circuit activating all of the said electrical devices.

2. I claim a device described in claim 1, also having all activated electrical devices being switching type devices.

3. I claim a device described in claim 2, the said switching devices being scr type switches.

4. I claim a device described in claim 2, the said switching devices being direct current relays.

* * * * *